United States Patent [19]

Pemberton

[11] Patent Number: 4,546,416

[45] Date of Patent: Oct. 8, 1985

[54] PHOSPHORESCENT FLASH-LIGHT

[76] Inventor: J. C. Pemberton, P.O. Box 20005, San Diego, Calif. 92120

[21] Appl. No.: 575,243

[22] Filed: Jan. 30, 1984

[51] Int. Cl.[4] ..... F21V 9/16

[52] U.S. Cl. ..... 362/84; 362/186; 362/202

[58] Field of Search ..... 362/84, 186, 202

[56] References Cited

U.S. PATENT DOCUMENTS

| | | | |
|---|---|---|---|
| 1,285,382 | 11/1918 | Renshaw | 362/84 X |
| 2,259,416 | 10/1941 | Gardner | 362/84 |
| 3,005,102 | 10/1961 | MacHutchin et al. | 362/84 X |
| 3,449,558 | 6/1969 | Whitmer | 362/84 X |
| 3,796,869 | 3/1974 | Stone | 362/84 |

*Primary Examiner*—Stephen J. Lechert, Jr.

*Attorney, Agent, or Firm*—Warren T. Jessup; Richard D. Slehofer

[57] ABSTRACT

A flashlight is fabricated from a conventional design and a conventional means for energizing it. The flashlight has a casing for holding the batteries. The casing is closed at one end and the other end is flared for holding the reflective dish, which has the bulb secured through an opening in its base. A transparent lens seals the volume of the dish. A bezel or rim attaches around the circumference of the lens. The bezel is made of a translucent plastic material, which has a phosphor material embedded into it. When the bulb is energized, the light beam touches the periphery of the bezel as it shines and charges the phosphor material. The flashlight and bezel can also be left in the sunlight to charge the phosphor material. After the phosphor material has been charged, the bezel emits a long-lasting glow called phosphorescence so that the flashlight can be found in the dark.

4 Claims, 2 Drawing Figures

PHOSPHORESCENT FLASH-LIGHT

BACKGROUND OF THE INVENTION

There are a large variety of substances which become luminescent or light emitting when stimulated or excited by suitable electromagnetic radiation such as lamplight or sunlight. The materials after absorbing the appropriate radiation continue to emit light or luminescence after the source of the existing energy is removed. When light is emitted only during the period of excitation, then the term is generally referred to as flourescence. When the light emission or the after-glow is delayed after the exciting energy is shut off then the delayed light emission is generally called phosphorescence. There has been a development of a large number of inorganic phosphors which act as phosphorescing materials. The materials are comprised of a host material or matrix compound such as the silicates, phosphates, sulfides, alkylhalides and the oxides of calcium, magnesium, barium and zinc. There are activators incorporated into these materials which can confer luminescent properties upon these host materials. Frequently used activators are magnanese, copper, silver, thallium, lead, cerium, chromium, titaniam, antimony and tin. Magnanese is a particularly effective activator in a wide variety of host materials when incorporated in amounts ranging from small traces up to the order of several percent. The color of a light emitted from these magnanese activated phosphorers is in the green or orange spectral regions.

SUMMARY OF THE INVENTION

This invention combines the phosphorescent qualities of the materials mentioned in the background invention embedded in a translucent ring or bezel attached to the face of a light bulb so that after this material has been excited by an appropriate electromagnetic radiation, the bezel will maintain an after-glow. When the flashlight is left in the dark, it can be found. This glow-in-the-dark property is especially suitable when a flashlight is used in an emergency situation in the dark. When the flashlight is left on a counter during the daylight hours the phosphorescing material is charged causing the bezel to glow throughout the night. The phosphorescing material discharges, but on the next day cycle, the material is recharged.

This glow-in-the-dark feature also finds use when the flashlight is being used with the incandescent bulb energized. The radiation emitted by the bulb also activates the phosphor material. For example, when a maintenance man or the like intermittently needs a flashlight when working in a dim area, he turns off the flashlight when not used to avoid draining the batteries. The bulb charges the phosphor material, and the worker can readily see the flashlight by the glow of the bezel. In this method, the repair man can use the flashlight as needed and turn it off when not needed and still have it visible instead of groping in the darkness trying to find wherever the flashlight had been laid down the previous time.

The invention is comprised of a conventional flashlight which has a hollow casing and is closed or sealed at one end and at the other end has a flared opening. The batteries are inserted into the hollow casing and a reflector dish is inserted into the flared opening. The reflective dish also holds the light bulb by means of a hole or opening at the base of the dish. A circular clear lens attaches to the upper rim of the reflective dish and conceals the interior volume of the dish from the outside. Next is the bezel which has a circumference which is large enough to hold the lens in place and also to be secured to the flared end of the casing. Typically this is by means of a threadable connection.

The bezel is made of a translucent plastic material which has the appropriate phosphorus material imbedded into or mixed with the plastic material. The bezel by virtue of its location will receive light as it is shined from the light bulb to recharge it. The casing includes a conventional on and off switch means for energizing the light bulb and typically a pair of DC batteries inside the casing.

Accordingly, it is the object of this invention to provide for a conventional flashlight which has a phosphor material embedded in the bezel or rim of the flashlight which will glow in the dark after it has been charged by sunlight, or lamplight from the flashlight bulb.

It is another object of this invention to provide for a conventional flashlight which can be used in a darkened area by energizing the flashlight bulb to charge the bezel and turning the flashlight bulb off and allowing the flashlight to be seen by the glowing ring resulting from the charged phosphor material embedded in the bezel of the flashlight.

DETAILED DESCRIPTION OF THE PREFERRED EMBODIMENT

Figure 1:
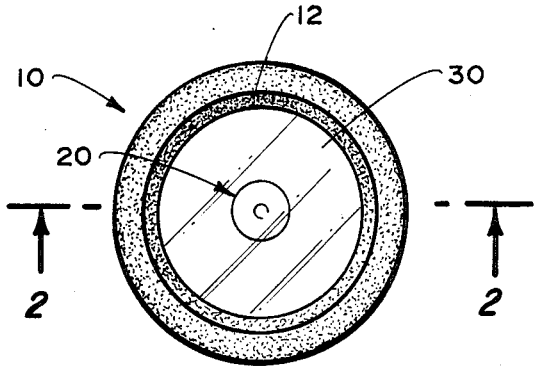
FIG. 1 is a front elevational view of the flashlight clearly showing the bezel with the phosphor material embedded in it.

FIG. 1 discloses a front elevational view of the portable flashlight. The bezel 10 is clearly shown as a ring-shaped structure and having an interior beveled surface 12, which slopes toward the flashlight bulb 20. Also disclosed is the lens 30.

The beveled edge 12 of the bezel 10 is a sub-component of the rim of the bezel. The rim extends forwardly of the lens 54, and is positioned to receive light from the bulb 20 which charges the phosphor material whenever the bulb of the flashlight is energized, whereby the flashlight may be visually located in a dark area when the bulb is not energized.

Figure 2:
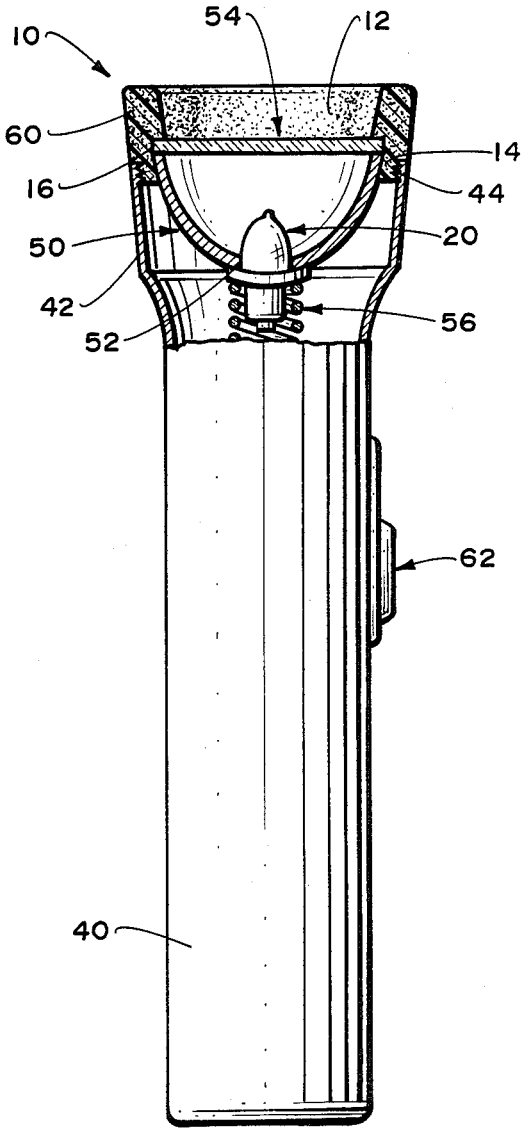
FIG. 2 is a side elevational view of the flashlight shown in partial cross-section taken along the line 2—2 of FIG. 1 and showing the relationship between the bezel and the light bulb.

FIG. 2 is a side elevational view with a partial cross-section cut away along the lines 2—2 of FIG. 1 disclosing the components comprising the head of the flashlight. The portable flashlight has a casing 40, which is closed at its distal end, and has at the opposite a flared opening 42. The flared opening allows for insertion of the DC batteries into the casing (not shown). The edge of the flared opening 42 has threads 44 for threadably connecting with the threads 14 of the bezel 10.

The reflective dish 50 is inserted into the flared opening 42. The bulb 20 can be positioned in an opening 52 at the base of the dish 50 for keeping the bulb in its proper alignment with the batteries and the reflective dish. The reflective dish 50 is of a generally parabolic shape so light emitted from the bulb 20 will be reflected through the lens 54 of the flashlight. There is a clear lens 54, which covers the face of the reflective dish, which protects the bulb 20 and keeps the dish clean.

When the bezel 10 is threaded onto the flared opening, a groove 16 holds the lens 54 and the dish 50 in place. The compression spring 56 maintains pressure on the dish and lens to keep them in the groove 16. The beveled edge or surface 12 of the bezel 10 is slanted so that the electromagnetic radiation emitted from the energized bulb 20 will shine on this beveled edge 12.

The bezel 10 is made of a translucent material such as a plastic. When the plastic material is still in its liquid form, the phosphor material 60 is added to the mixture so that the resulting molded bezel has the phosphor material uniformly dispersed throughout the bezel as disclosed by the flakes 60 in the Figures. This phosphor material 60 absorbs electromagnetic radiation from the energized bulb 20, which charges it for later phosphorescing in the form of visible light.

The phosphor material 60 can be charged by exposing the bezel to the energized flashlight bulb, the sunlight, or a lamplight. The type of phosphor material to be added to the bezel 10 can be any combination of materials as for example those described in the Background of the Invention. The only requirement is that the phosphor material be able to phosphoresce and be visible for at least 1 hour after it has been fully charged.

There are other methods of fabricating the phosphor embedded bezel. For example, the translucent material can be a powder and the phosphor powder mixed in with it and thereafter the resulting mixture sintered in a mold to form the bezel.

The utility of this portable flashlight is apparent when a mechanic requires the intermittant use of a flashlight for spot viewing while working on a piece of equipment in a dimly lit area. To avoid draining the batteries, the mechanic turns off the flashlight between uses and sets it aside. Because he is concentrating on the equipment he is working on, he usually forgets where he had placed the flashlight when he needs it again. As a result he must disrupt his work in progress and blindly feel around his work area to find the flashlight. This can become quite a distraction to the mechanic.

With the phosphorescing bezel, the portable flashlight glows like a ring in the dark, so that the mechanic can readily see where he previously had left the flashlight. Each time he uses the flashlight, the bulb charges the bezel to maintain the brightness of the glow in the darkness.

The flashlight can also be used as an emergency or standby flashlight in the event of power failure at night. The flashlight with the bezel can be left on a counter top throughout the day to charge the phosphor material. During the night the phosphorescing diminishes as the material spontaneously discharges. However, the ring will be visible throughout the night. The next day the phosphor material is again recharged and the cycle is repeated.

There is an on-off switch 62 for energizing the flashlight by allowing the current to pass from the batteries to the bulb 20.

It is contemplated that a bezel containing the phosphor material could be fabricated into various shapes and dimensions and marketed as an item to be attached to the lens of a conventional flashlight to give the flashlight the glow in the dark capability. It is also contemplated that the replacement bezels or rims for popular brand conventional flashlights can be manufactured with the phosphor material and marketed as replacement bezels for these popular style flashlights.

Whereas the present invention has been shown and described herein in what is conceived to be the best mode contemplated, it is recognized that departures may be made therefrom within the scope of the invention which is therefore not to be limited to the details disclosed herein but is to be afforded the full scope of the invention.

What is claimed is:

1. A portable flashlight comprising:

a casing having a flared opening at one end and closed at the other end for holding a battery;

a reflector dish having a light bulb positioned at its base, said dish placed into the open end of said casing for reflecting the light from said bulb whenever said bulb is energized;

a lens placed against the face of said reflector for dispersing the light emitting from said energized bulb;

a bezel attached around said lens having a rim containing a phosphor material and extending forwardly of said lens in position to receive light from said bulb, thereby to charge said phosphor material whenever said bulb is energized, whereby the flashlight may be visually located in a dark area when said bulb is not energized.

2. The flashlight as recited in claim 1 wherein said bezel comprises a plastic material embedded with a phosphor material for storing light radiation from said bulb while said bulb is energized and thereafter phosphorescing after said bulb is de-energized enough to be visible in the dark over a given period.

3. The flashlight as recited in claim 2 wherein said bezel comprises a ring having a beveled interior rim and threadably attached to said flared opening.

4. A device for seeing a portable flashlight in the dark comprising:

a bezel attached around the lens of a flashlight and made of a phosphor material;

said bezel having a rim extending forwardly of the lens and in position to receive light from the bulb, thereby to charge said phosphor material whenever the bulb of the flashlight is energized, whereby the flashlight may be visually located in a dark area when the bulb is not energized.

* * * * *